US007073439B2

(12) United States Patent
Takahashi et al.

(10) Patent No.: US 7,073,439 B2
(45) Date of Patent: Jul. 11, 2006

(54) ROTARY PRESS

(75) Inventors: Kenji Takahashi, Chiba (JP); Tetsu Ohno, Chiba (JP)

(73) Assignee: Miyakoshi Printing Machinery Co., Ltd., Chiba (JP)

( * ) Notice: Subject to any disclaimer, the term of this patent is extended or adjusted under 35 U.S.C. 154(b) by 0 days.

(21) Appl. No.: 10/804,506

(22) Filed: Mar. 19, 2004

(65) Prior Publication Data

US 2005/0016401 A1 Jan. 27, 2005

(30) Foreign Application Priority Data

Jul. 24, 2003 (JP) ..... 2003-278759
Jan. 5, 2004 (JP) ..... 2004-000257

(51) Int. Cl.
*B41F 35/00* (2006.01)

(52) U.S. Cl. ..... 101/424.1; 101/488

(58) Field of Classification Search ..... 101/424.1, 101/488, 487, 219, 174, 178, 177
See application file for complete search history.

(56) References Cited

U.S. PATENT DOCUMENTS 4,008,661 A * 2/1977 Mathis ..... 101/181
4,662,971 A * 5/1987 Adams ..... 156/270
5,024,156 A * 6/1991 Hank et al. ..... 101/216
5,142,978 A * 9/1992 Borel ..... 101/77
5,447,566 A * 9/1995 Loiacono ..... 118/249
5,524,805 A * 6/1996 Shiba et al. ..... 226/108
5,547,225 A * 8/1996 DeAngelis ..... 281/21.1
5,765,294 A * 6/1998 Puschnerat ..... 34/381
6,079,330 A * 6/2000 Aoki et al. ..... 101/424.1
6,108,436 A * 8/2000 Jansen et al. ..... 382/112
6,435,094 B1 * 8/2002 Siler et al. ..... 101/488
6,510,791 B1 * 1/2003 Hillebrand et al. ..... 101/231

FOREIGN PATENT DOCUMENTS

| | | |
|---|---|---|
| GB | 845840 | 8/1960 |
| JP | 53-7841 | 3/1978 |
| JP | 06-182963 | 7/1994 |
| JP | 07-227952 | 8/1995 |
| JP | 08-245028 | 9/1996 |
| JP | 11-020134 | 1/1999 |

* cited by examiner

*Primary Examiner*—Anthony H. Nguyen
(74) *Attorney, Agent, or Firm*—Cohen, Pontani, Lieberman & Pavane

(57) ABSTRACT

A rotary press is provided that prevents a print from contamination with a color different from a printing color. The rotary press comprising a printing unit made of a set of printing cylinders such as plate and blanket cylinders or plate and impression cylinders for printing paper; and a dryer disposed downstream of the printing unit for drying the paper printed, has a guide roller included therein for guiding the printed paper from the printing unit into the dryer wherein the guide roller has a diameter which is equal to, or a an integral multiple of, a diameter of a printing cylinder in the printing unit and is adapted to rotate synchronously with the printing cylinder and at a peripheral speed that is identical to that at which the printing cylinder is rotated.

7 Claims, 6 Drawing Sheets

ROTARY PRESS

BACKGROUND OF THE INVENTION

1. Field of the Invention

The present invention relates to a rotary press having a guide roller or rollers for guiding paper from a printing section into a drier disposed downstream of it, and in particular is applicable to such a rotary press that performs perfect printing. The invention is further applicable to a multiweb type rotary press in which a plurality of continuous papers or webs are printed in parallel to one another with a plurality of printers and the printed papers or webs are then laid one on top of another to form a product from them.

2. Description of the Prior Art

A continuous paper or web printed by a rotary press cannot be wound onto a guide roller or the like before the printing ink on it is dried through a dryer to prevent ink transfer. For this reason, it has been customary that such a drier is disposed directly downstream of a printing unit in the rotary press.

In a rotary press that performs perfect printing, e.g., a vertical offset rotary press having a plurality of groups of B—B (blanket-blanket) printing cylinders vertically disposed, however, where the dryer is mounted horizontally on a floor surface for the convenience' sake of the space in which it is disposed, there arises the need to guide each printed paper to the inlet of the drier by means of a guide roller or the like. But it could then be unavoidable that a printed paper surface which remains undried may come into contact with a guide roller surface, causing the ink from a print to adhere on the guide roller and then to remove or transfer back to a paper surface, thereby contaminating the printed paper or print. Therefore, a means is made necessary that prevents ink from transferring from the undried printed paper surface onto a surface of the guide roller disposed downstream of the printing section.

The conventional ink transfer preventing measure of this type is to have an ink transfer preventive sheet wound on the surface of such a guide roller (see, e.g., JP S53-7841 B and JP H11-20134 A) or to cool ink on the paper surface with a roller whose surface is cooled (see, e.g., JP H06-182963 A). To prevent ink transfer, a measure has also been known that guides the printed paper non-contactually while blowing air from the guide surface of a guide bar such as a non-rotating turn-bar (see, e.g., JP H08-245028 A).

While the conventional guide roller having the ink transfer preventive sheet wound thereon is capable of limiting the ink transfer onto the guide roller surface, it cannot eliminate the same completely and requires the guide roller surface to be washed periodically. Also, the means that cool the undried ink on the paper surface for preventing the ink from transferring to a downstream roller requires a special makeup for cooling the roller, and hence become costly. Further, the aforementioned measure of guiding the paper non-contactually requires a special makeup for blowing air, and here again becomes costly. Furthermore, with the paper surface floated by air, this measure presents the problem that the paper fluctuates in tension and its registration is not steadied.

That a drier is disposed immediately downstream of a printing unit is true for a multiweb type rotary press system as well in which a plurality of continuous papers or webs are printed side by side with a plurality of printers and after they are printed are laid one on top of another to form a product from them. In such a rotary press system as shown in FIG. 1, rotary presses 5*a*, 5*b* each of which comprises a paper feeder 1, a printing unit 2, a drier 3 and a cooler 4, and whose number corresponds to the number of webs 6 are disposed in parallel with one another. The webs 6 printed are laid one on top of another with an inverting unit 7*a*, 7*b* using a plurality of guide rollers and turn-bars each disposed downstream of the cooler 4 in each of the rotary press 5*a*, 5*b*, and thereafter are allowed to travel via various guide rollers into a working and a processing section comprising a cutting and a folding unit and so on.

In order to circumvent the problem that not only is a large space required but also both the operability and controllability of the system become poor if the rotary presses 5*a*, 5*b* are disposed in parallel on a floor as mentioned above, JP H07-227952 A describes a rotary press as shown in FIG. 2 in which in conjunction with a plurality of paper feeders 1*a*, 1*b* disposed in series with one another a plurality of printing units 2*a* are disposed one above another. Disposed downstream of these printing units 2*a*, 2*b* are a dryer 8 through which webs 6, 6 printed through the respective printing units 2*a*, 2*b* are passed in parallel to dry the printing ink thereon simultaneously and a cooler 9 through which the webs 6, 6 with the ink dried are cooled.

While the abovementioned makeup having a plurality of printing units disposed one above another is less disadvantageous than that of the horizontal parallel type not only in terms of the space of its installation on the floor but also in its workability and operability, there is presented the problem anew that the size is enlarged vertically.

Further, where printing units placed one above another comprise printing cylinders to be exchanged to meet with a change in printing size, it becomes troublesome to make an exchange for an upper printing cylinder because of a raised position of its exchange and an increased distance from its storage position to the raised position where it is worked on for replacement.

BRIEF SUMMARY OF THE INVENTION

Made to solve the problems mentioned above, the present invention has for its object to provide a rotary press which with no substantial rise in cost and without entailing unsteadiness in registration is capable of preventing a print from contamination with any color different from a printing color. It is also an object of the present invention to provide a multiweb rotary press which without widening or vertically increasing the space for its installation is capable of preventing a print from contamination with any color different from a printing color.

The present invention provides in a form of implementation thereof a rotary press which comprises a printing unit made of a set of printing cylinders such as plate and blanket cylinders or plate and impression cylinders for printing paper; and a dryer disposed downstream of the printing unit for drying the paper printed, characterized in that a guide roller is included therein for guiding the printed paper from the printing unit into the dryer wherein the guide roller has a diameter which is equal to, or an integral multiple of, a diameter of a printing cylinder in the printing unit and is adapted to rotate synchronously with the printing cylinder and at a peripheral speed that is identical to that at which the printing cylinder is rotated.

According to this makeup, the paper printed by the printing unit is guide by the guide roller in a paper path between the printing unit and the drier. Then, by virtue of the fact that the guide roller has a diameter which is equal to, or an integral multiple of, a diameter of a printing cylinder in the printing unit and is adapted to rotate synchronously with the printing cylinder and at a peripheral speed that is identical to that at which the printing cylinder is rotated, the guide roller is always contacted by an identical portion of a image printed onto the paper and a print on the paper is thus prevented from being contaminated with any color other than a printing color.

Also, the makeup described above which gives rise to the advantage that the paper can be guided without causing a print thereon to be contaminated with any color other than a printing color at the downstream of the printing section is advantageously applicable to a vertical offset rotary press in which a plurality of printing sections are vertically arranged one above another. Then, the drier need not be set up above the printer as at a position downstream of the printing section but on a floor surface away from the downstreammost printing section. As a result, the height of the vertical offset rotary press can be lowered. Also, applied to a horizontal rotary press in which a plurality of printing sections are horizontally arranged side by side, the makeup allows a paper path to be provided at need between the hindmost printing section and the dryer where the paper can be guide by the guide roller. Further, the guide roller may have its surface processed unevenly with a ceramic material having a special coating to prevent ink from adhering or depositing thereon.

The present invention also provides in another form of implementation thereof a rotary press which has the makeup mentioned above and comprises a plurality of paper feeders, a plurality of such printing units as aforesaid and the dryer which together form a multiweb rotary press wherein the paper feeders for supplying a plurality of webs, respectively, are disposed in line in a direction generally in which the webs are supplied individually therefrom and the printing units for printing the webs, respectively, are disposed in line in a direction generally in which the webs from the paper feeders are to travel therethrough individually whereby the webs are printed in parallel with one another, and the printed webs are then dried and thereafter placed one on top of another to form a product therefrom, characterized in that the web printed through the printing unit that is the downstreammost is passed directly into the drier and that the said guide roller is disposed downstream of each of the other printing units for guiding each of the other webs printed by them respectively so as to bypass those printing units or unit located downstream of them respectively and then to travel into the dryer.

Requiring the printing units to be disposed in line in a direction generally in which the webs are to travel therethrough, this further makeup makes the rotary press longer horizontally by the number of the printing units, but this does not go beyond the length of an ordinary multicolor rotary press and thus allows it to be installed without the need to extraordinarily widen the space for its installation and to make its height equal to that of an ordinary rotary press.

And, in the arrangement that the printing units are disposed in line in a direction generally in which the webs are to travel therethrough, the webs printed by the printing units other than the downstreammost can be guided by the respective guide rollers or guide roller sets to bypass those printing units or unit located downstream of them respectively and then to travel into the dryer. Then, a print on each printed web is prevented from being contaminated with any color other than a printing color.

Also, in the arrangement that a plurality of printing units are disposed in line in a direction generally in which the webs are to travel therethrough, this rotary press when a single web is to be passed through these printing units successively can be used as a conventional multicolor rotary press and thus is available for both multiweb printing and multicolor printing.

Also, in the rotary press of any makeup as mentioned above, the printing cylinder in a said printing unit and the guide roller may each be made replaceable so that there is a replacement guide roller that can be replaced with in confirmation of a diameter of a replacement printing cylinder when replaced with.

With this feature, the present invention is advantageously applicable to a rotary press in which a printing unit comprises a replaceable cylinder unit.

Another feature of the present invention is characterized in that a said printing unit may be constituted with a duplex printer.

BRIEF DESCRIPTION OF THE DRAWINGS

These and other objects, features and advantages of the present invention as well as other manners of its implementation will become more readily apparent, and the invention itself will also be better understood, from the following detailed description when taken with reference to the drawings attached hereto showing certain illustrative forms of implementation of the present invention. In the drawings.

DETAILED DESCRIPTION

Figure 1:
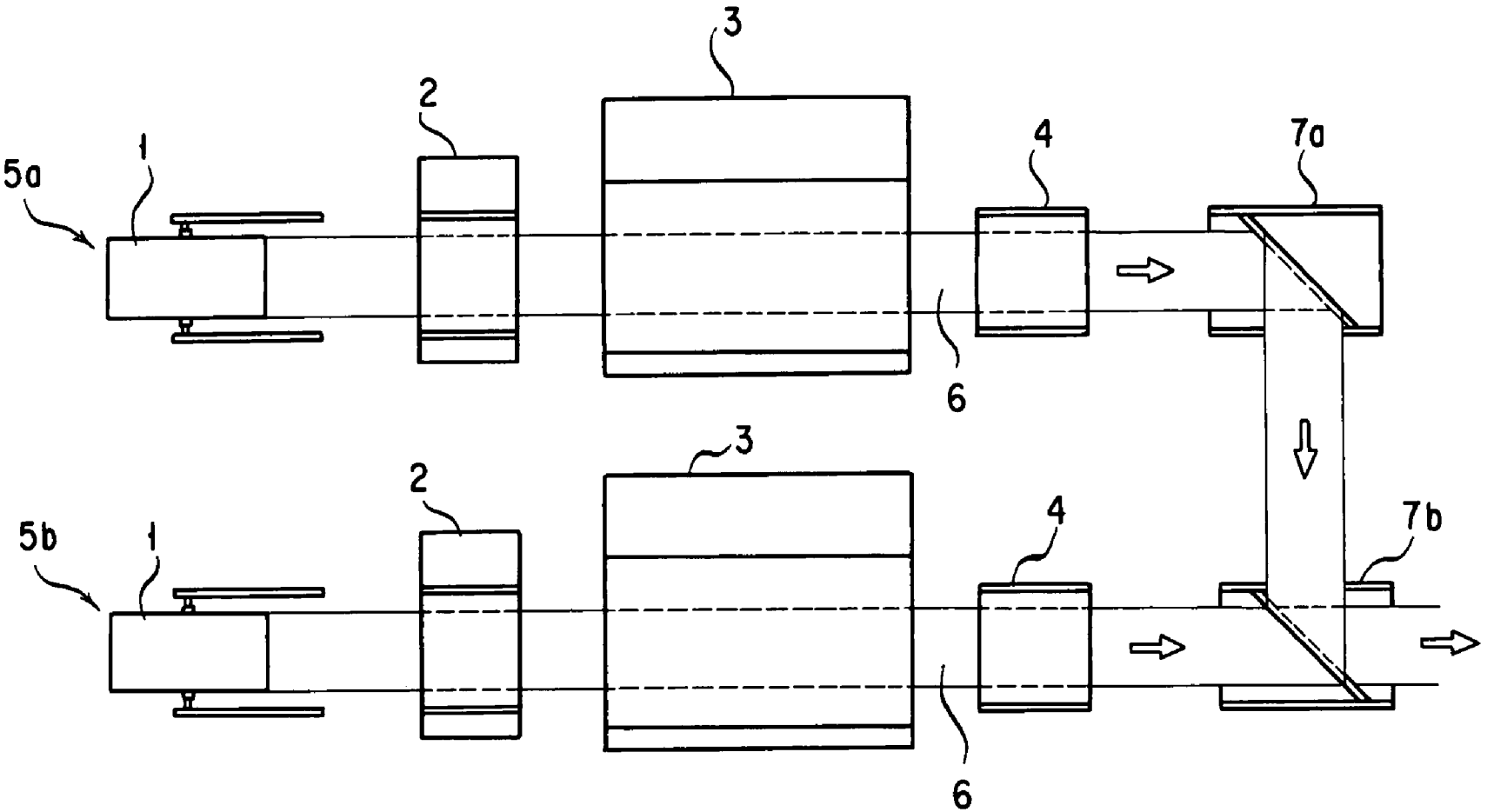
FIG. 1 is a top plan view illustrating an example of the conventional multiweb type rotary press.
Figure 2:
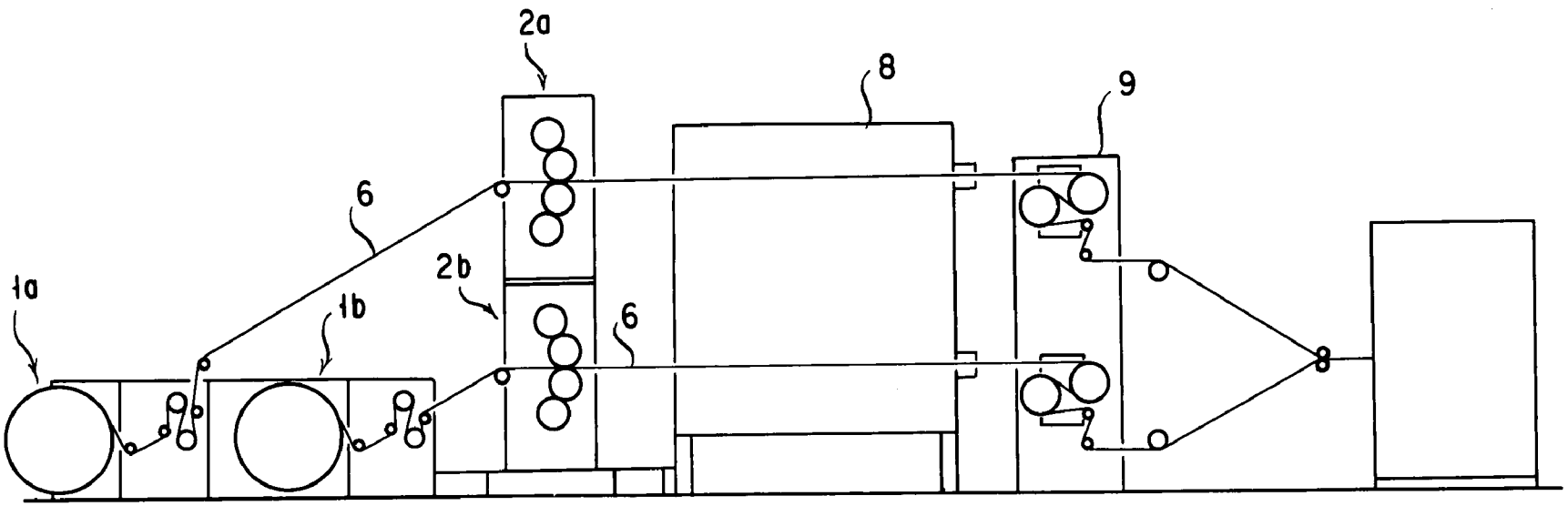
FIG. 2 is a side elevational view illustrating another example of the conventional multiweb type rotary press.
Figure 3:
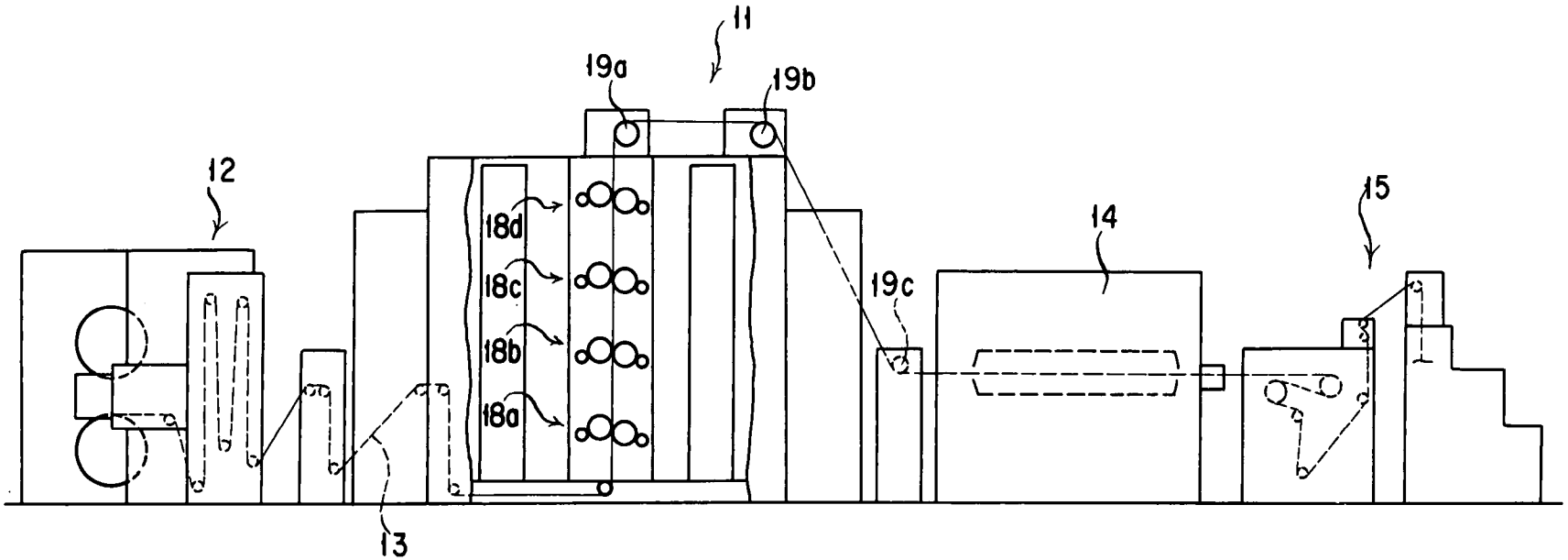
FIG. 3 is a diagrammatic front view illustrating a vertical offset rotary press representing a first form of implementation of the present invention.
Figure 4:
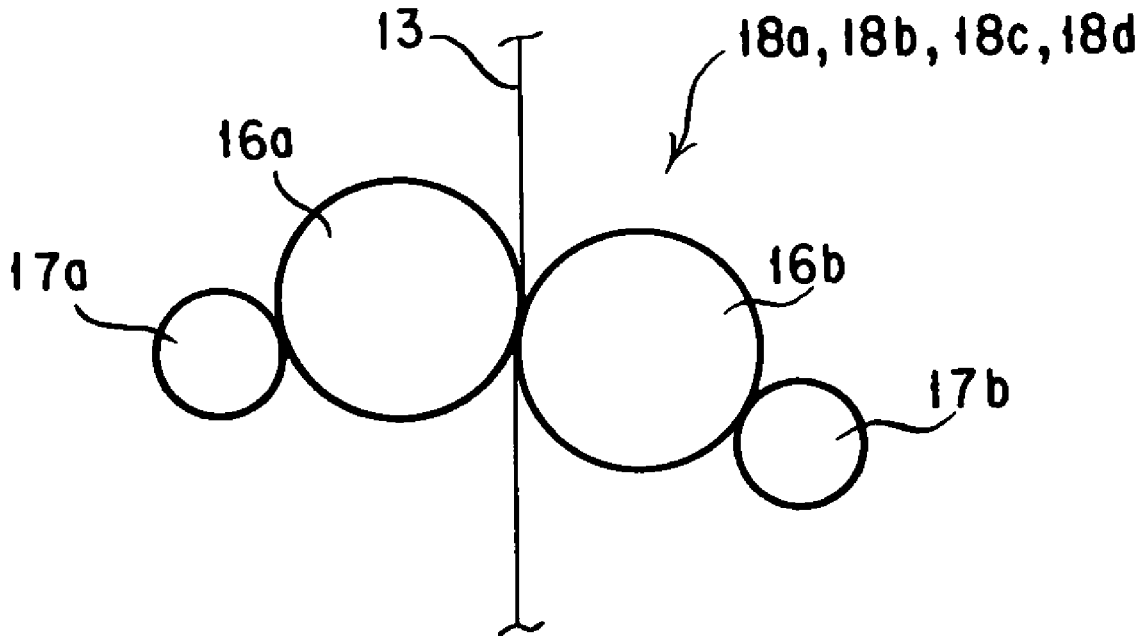
FIG. 4 is an explanatory view illustrating a perfect printing cylinder unit.

Referring to FIGS. 3 and 4, an explanation is given in respect of a first form of implementation of the present invention. FIG. 3 shows a vertical B-B offset rotary press. There are shown a printing section (printing unit) 1, a paper feeder 12 that supplies and feeds a continuous paper or web 13 into the printing section 11, a dryer 14 disposed downstream of the printing section 11 and mounted horizontally on the floor surface, and a working section 15. The printing section 11 may include, for example, four (4) perfect printing cylinder units 18*a*, 18*b*, 18*c* and 18*d* as shown in FIG. 3, each of which as shown in FIG. 4 comprises a pair of blanket cylinders 16*a* and 16*b* rotationally engaged with each other and a pair of plate cylinders 17*a* and 17*b* rotationally engaged with the blanket cylinders 16*a* and 16*b*, respectively.

In the printing section 11, the web 13 is designed to travel from lower to upwards while it is printed in four colors on its both sides by the first to fourth perfect printing cylinder units 18*a* to 18*d*. And, the web 13 passed out of the uppermost perfect printing cylinder unit 18*d* is passed through the drier 14 where images of ink on the web surfaces are dried. The drier 14 may be any suitable conventional drier using hot air or UV rays.

Then, with the drier 14 mounted horizontally on the floor surface downstream of the printing section 11, a nonlinear web path of a length from the downstreammost perfect printing cylinder unit 18*d* down to an inlet of the drier 14 is needed in which a plurality guide rollers 19*a*, 19*b*, 19*c* and 19*d* are arranged to guide the undried web 13 from the printing section.

Here, each of the guide rollers 19*a*, 19*b*, 19*c* and 19*d* is designed to have a peripheral length (or a diameter) that is equal to the peripheral length (or the diameter) of the blanket cylinder 6*a*, 6*b* and at the same time is designed to be driven by a drive unit (not shown) to rotate at a peripheral speed equal to that at which the blanket cylinder 16*a*, 16*b* is driven to rotate, namely to rotate synchronously with the latter, so that the web 13 is guided and fed by each of them.

Further, so as to prevent ink from adhering or depositing up thereon, each of the guide rollers 19*a*, 19*b* and 19*c* is fitted on its surface with a ceramic jacket, which in turn has a special coating applied to its surface.

With the vertical B—B offset rotary press constructed as mentioned above, while the web 13 printed at the printing section 11 comes into contact with the guide rollers 19*a*, 19*b* and 19*c* successively before it reaches the drier 14, identical portions of the printed images are always allowed to come in contact with the guide rollers 19*a*, 19*b* and 19*c* by virtue of the fact that each of these guide rollers 19*a*, 19*b* and 19*c* is identical in peripheral length to each of the blanket cylinders 16*a* and 16*b* and is mechanically driven to rotate at a peripheral speed that is identical to that of the blanket cylinder 16*a*, 16*b*. If a printing image on the web 13 is copied onto a guide roller, then the copied image on the guide roller comes into contact with no region on the web 13 other than an area where the same image is printed on the moving web 13. Thus, the possibility that the printed surface may be contaminated by a color other than a printed color is prevented and eliminated. Further, this advantage is even more assured when each of the guide rollers 19*a*, 19*b*, 19*c* and 19*d* is fitted on its surface with a ceramic jacket, which in turn has a special coating applied to its surface, or alternatively when each of these guide rollers is directly formed on its surface with such a special coating applied by thermally spraying ceramic onto the surface to prevent ink from adhering or depositing thereon.

Although the first form of implementation of the present invention is mentioned above as applied to a vertical offset rotary press, it should be noted that this form of implementation of the invention is equally applicable to a horizontal offset rotary press as well in which a plurality offset printing units are arranged horizontally side by side. In this case, too, a plurality of guide rollers are arranged in a web path between the final printing unit in the printing section and the dryer such that each of these guide rollers is made identical in peripheral length to each of the blanket rollers and is driven to rotate at a peripheral speed identical to that at which each of the blanket rollers is driven to rotate.

In the case of a horizontal offset rotary press, a web path between the final printing unit in the printing section and the dryer is not provided according to the conventional practice. That is, if such a web path is provided, then arranging guide rollers there gives rise to the problem of ink transfer or transfer. With the abovementioned guide rollers included according to the present invention, however, it becomes possible to provide, as occasion demands, a web path at the upstream side of the dryer, e.g., for processing the web further there in any way as desired.

Also, the guide rollers 19*a*, 19*b* and 19*c* may, respectively, be made identical in peripheral length to the plate cylinders 17*a* and 17*b* in contact to the blanket cylinders 16*a* and 16*b* to achieve the same advantage.

It should further be noted that the rotary press according to the present invention is applicable not only to an offset preess but also to a perfecting relief rotary press. In this latter case as well, the guide rollers are made identical in peripheral length to a plate cylinder or impression cylinder and designed to be driven to rotate at a peripheral speed identical to that at which it is driven to rotate.

Figure 5:
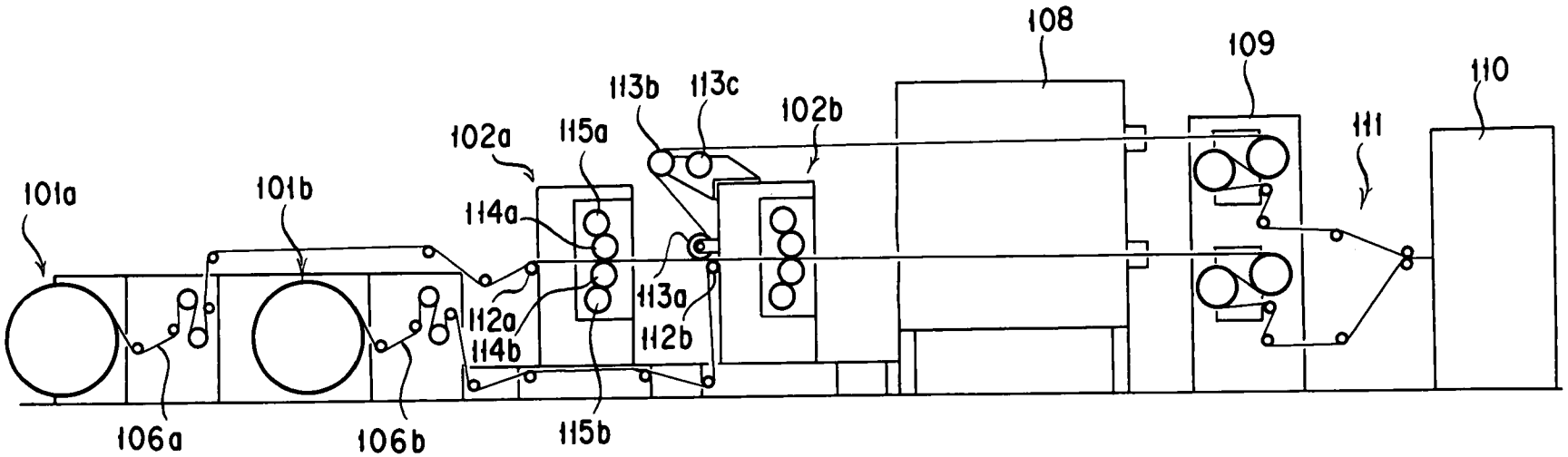
FIG. 5 is a side elevational view illustrating a multiweb type rotary press representing a second form of implementation of the present invention.

Referring next to FIG. 5, an explanation is further given in respect of a second form of implementation of the present invention as applied to a multiweb rotary press.

Paper feeders corresponding in number to multiple webs, e.g., a first and a second paper feeder 101*a* and 101*b* for supplying a first and a second web 106*a* and 106*b*, respectively, are arranged in line in the direction in which the webs are driven to travel. And, downstream of the paper feeders 101*a* and 101*b*, printing units corresponding in number to the paper feeders 101*a* and 101*b*, e.g., a first and a second printing unit 102*a* and 102*b* for printing images on the first and second webs 106*a* and 106*b*, respectively, are arranged in line in the direction in which the webs are driven to travel. Further, downstream of the printing units 102*a* and 102*b*, a dryer 108 and a cooler 109 are arranged in line in the direction of travel of the webs 106*a* and 106*b* so that in the dryer 108 and cooler 109 the webs 106*a* and 106*b* are passed with a vertical space between them and in parallel to dry ink thereon and are then cooled.

Disposed downstream of the dryer 109 across a web path 111 of a suitable length is a superposing section 110 in which the multiple webs 106*a* and 106*b* past the dryer 109 are placed one on top of another so as to coincide with one another and are then folded and so on.

The web 106*a* supplied from the first paper feeder 101 disposed upstream of the second paper feeder 101*b* is directed to bypass the latter above it and led onto an inlet roller 112*a* in the first, upstream printing unit 102*a*. The web 106*b* supplied from the second, downstream paper feeder 101*b* is directed through a plurality of paper guiding rollers to bypass the first, upstream printing unit 102*a* below it and led onto an inlet roller 112*b* in the second, downstream printing unit 102*b*.

Downstream of the printing unit 102*a* immediately upstream of the printing unit 102*b* that is the most downstream of the multiple printing units 102, there are provided a plurality of guide rollers, e.g., a first and a second guide rollers 113*a* and 113*b*, for directing the web 106*a* past that upstream printing unit 102*a* to travel into the dryer 108 while bypassing that downstreammost printing unit 102*b* wherein the guide rollers are as shown supported from a frame of that downstreammost printing unit 102*b* although they may be supported from any other frame separately provided.

Each of the first and second printing units 102*a* and 102*b* as in e. g., a B-B offset printer comprises a pair of blanket cylinders 114*a* and 114*b* of an identical diameter rotationally engaged with each other, a pair of plate cylinders 115*a* and 115*b* rotationally engaged with the blanket cylinders 114*a* and 114*b*, respectively, and having a diameter identical to that of these blanket cylinders 114*a* and 114*b*, and an ink furnishing unit (not shown) for supplying ink onto printing plates attached to the plate cylinders 115*a* and 115*b*, respectively.

The first and second guide rollers 113*a* and 113*b* for guiding the web 106*a* past the first printing unit 102*a* to travel into the dryer 108 while bypassing the second printing unit 102*b* downstream of it are identical in diameter, namely in peripheral length to the blanket cylinders 114*a* and 114*b* in the first printing unit 102*a*. And, these guide rollers 113*a* and 113*b* are coupled to a drive unit (not shown) so that they are rotated synchronously with the blanket cylinders 114*a* and 114*b* at an identical peripheral speed each in a direction in which to cause the web 106*a* to travel.

The guide rollers 113*a* and 113*b* have their surfaces processed so as to prevent ink from adhering or depositing thereon. As an example, these guide rollers are each fitted with a ceramic jacket having a special coating applied thereto.

In the abovementioned makeup, the web 106*a* supplied from the first paper feeder 101*a* is fed onto the inlet roller 112*a* of the first printing unit 102*a* by bypassing above the second paper feeder 101*b* so that its both sides are offset-printed with the blanket cylinders 114*a* and 114*b* in the first printing unit 102*a*. The web 106*a* past the first printing unit 102*a* is guided by the first and second guide rollers 113*a* and 113*b* to travel into the dryer 108 by bypassing above the second printing unit 102*b*.

Then, with the first and second guide rollers 113*a* and 113*b* being identical in diameter to the blanket cylinders 114*a* and 114*b* and rotated at a peripheral speed identical to that at which they are rotated, each of the guide rollers 113*a* and 113*b* is always contacted by an identical part of a image that is printed by the first printing unit 102*a*, namely that is transferred from each of the blanket cylinders 114*a* and 114*b* onto the web 106*a*.

Thus, even if a certain part of a printed image on the web 106*a* is copied onto surfaces of the first and second guide rollers 113*a* and 113*b*, then those surfaces of the first and second guide rollers 113*a* and 113*b* onto which that part of the image is copied are contacted repeatedly by an identical part of such a printed image on the traveling web 106*a* and as a result a printed surface or a print on the web 106*a* is prevented from being contaminated by any color other than a printing color.

Furthermore, with the guide rollers 113*a* and 113*b* having their surfaces processed so as to prevent ink from adhering or depositing thereon, it is possible to minimize the transfer of ink onto those surfaces.

On the other hand, the web 106*b* supplied from the second paper feeder 101*b* is fed onto the inlet roller 112*b* of the second printing unit 102*b* by bypassing the first printing unit 102*a*, and is printed by the second printing unit 102*b*. And, since this second printing unit 102*b* is the most downstream, the web 106*b* past it need not bypass any other printing unit and can thus be led directly into the drier 108 without being guide by any such guide roll.

For each of the printing units 102*a* and 102*b* in the form of implementation illustrated, use may be made of one with replaceable cylinders. Then, a replacement cylinder unit in each printing unit 102*a*, 102*b* is used that meets with a printing size required.

In such a makeup, the first and second guide rollers 113*a* and 113*b* need be replaced with those which are identical in diameter to the blanket cylinders replaced with.

Accordingly, the first guide roller 113*a* relatively low in vertical position is made replaceable. On the other hand, the second guide roller 113*b* higher in vertical position is cumbersome to replace, and hence a third guide roller 113*c* that is identical in diameter to the blanket cylinders in another replacement cylinder unit is provided beforehand as positioned at this same height.

In such a form of implementation as described, when the replacement cylinder units in the printing units 102*a* and 102*b* are replaced, the first guide roller 113*a* is replaced and one of the second and third guide rollers 113*b* and 113*c* is selected for use, according to the blanket cylinders in the replacement cylinder units after replacement, and then the webs are passed therethrough. To mention further, it is also possible to replace the upper guide rollers 113*a* and 113*b* altogether.

Although in the form of implementation described above the paper feeders and the printing units are each shown to be two in number, they may each be three or more in number in implementing the present invention.

Figure 6:
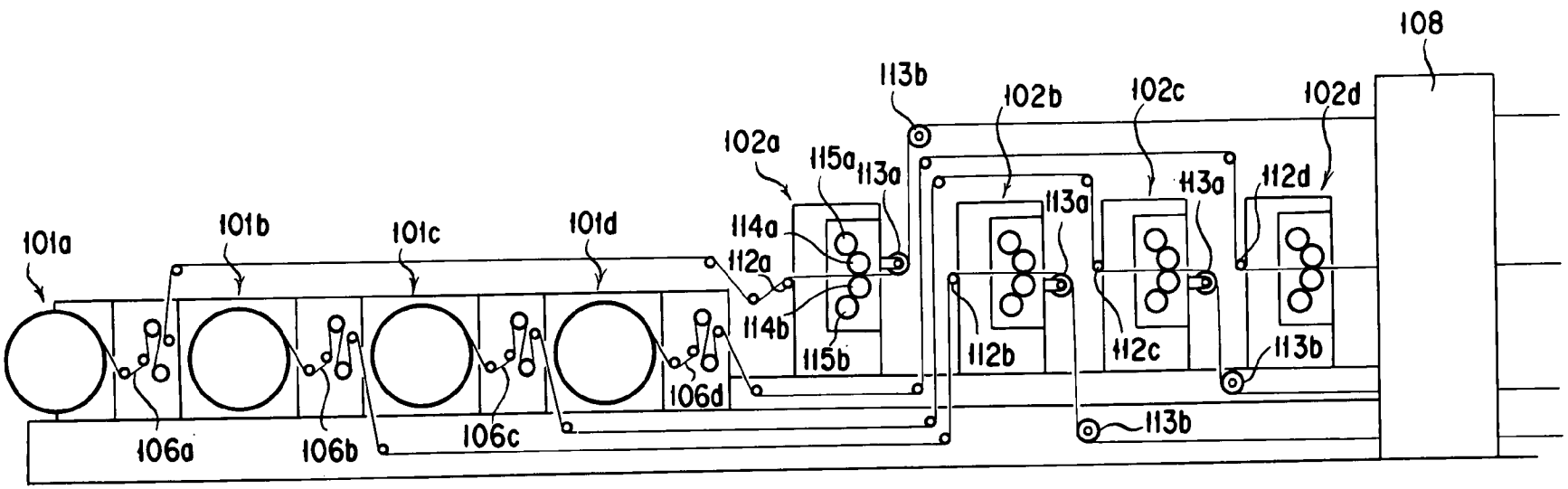
FIG. 6 is a side elevational view illustrating a multiweb type rotary press representing a third form of implementation of the present invention.

For example, as in a third form of implementation of the invention as shown in FIG. 6 four (4) paper feeders and four (4) printing units may be used. Then, a web 106*a* supplied from a first, upstreammost paper feeder 101*a* is allowed to bypass above a second, a third and a fourth paper feeder 101*b*, 101*c* and 101*d* lying downstream thereof and is then passed into a first, upstreammost printing unit 102*a*.

A web 106*b* from the second paper feeder 101*b* is allowed to bypass below the third and fourth paper feeders 101*c* and 101*d* and the first printing unit 102*a* and is then passed into a second printing unit 102*b*. Likewise, a web 106*c* from the third paper feeder 101*c* bypasses below the fourth paper feeder 101*d* and the first printing unit 102*a* and above the second printing unit 102*b* and is passed into a third printing unit 102*c* whereas a web 106*d* from the fourth paper feeder bypasses below the first printing unit 102*a* and above the second and third printing units 102*b* and 102*c* and is passed into the fourth printing unit 102*d*.

On the other hand, guide rollers 113*a* and 113*b* are provided downstream of each of the printing units upstream of the downstreammost printing unit to guide each of the webs past the corresponding printing unit to bypass above or below the printing units or unit located downstream thereof and then to travel into the dryer 108.

Although in each of the forms of implementation described above each of the printing units is shown to comprise a B—B offset printer, the present invention is also applicable to the use of a half-deck offset printer, namely using a single side printer. In this case, only a guide roller that contacts a print side is made identical in diameter to a blanket cylinder. Furthermore, the present invention is not limited to the use of an offset printer but may make use of a printer in which a web contacts a printing or plate cylinder wherein a guide roller is made identical in diameter to a printing plate of the printing or plate cylinder. What is essential here is that the guide roller 113*a*, 113*b* be rotationally engaged with the web 106*a*, 106*b*, 106*c* and the guide roller 113*a*, 113*b* be identical in diameter to a printing cylinder for printing the web and be rotated synchronously therewith and at a peripheral speed identical to that at which it is rotated.

Also, while the forms of implementation illustrated above require that the guide roller 113*a*, 113*b* be identical in diameter to a printing cylinder and be rotated at a peripheral speed identical to that at which the printing cylinder is rotated, such a guide roller when the present invention is implemented may more generally have a diameter that is equal to, or is given by an integral multiple of, a diameter of a printing cylinder and be rotated at a peripheral speed that is identical to that at which the printing cylinder is rotated.

Further, in the forms of implementations of the invention described above, a plurality of printing units 102*a*, 102*b*, . . . are arranged in series with one another in a direction in which a web is to travel. Thus, a rotary press with this arrangement when a web 106*a* from a first, upstreammost paper feeder 101*a* is allowed to bypass the other paper feeders and is then passed into the first printing unit 102*a* and then into the other printing units successively without intervention of a guide roller, can also be used as a usual rotary press as well for printing the web with multiple colors corresponding in number to the number of the printing units.

Also, although in the forms of implementation of the invention illustrated above a plurality of paper feeders 101*a*, 101*b*, . . . are shown to lie in line with the direction in which webs 106*a*, 106*b*, . . . are allowed to travel into a plurality of printing units 102*a*, 102*b*, . . . , these paper feeders 101*a*, 101*b*, . . . may be disposed to lie in line with a direction that is perpendicular to the direction in which the webs are led into the printing units 102*a*, 102*b*, . . . so that the respective webs 106*a*, 106*b*, . . . supplied from the paper feeders 101*a*, 101*b*, . . . are redirected by a turn-bar arrangement or the like to travel towards the printing units 102*a*, 102*b*, . . .

Although the present invention has hereinbefore been set forth with respect to certain illustrative embodiments thereof, it will readily be appreciated to be obvious to those skilled in the art that many alterations thereof, omissions therefrom and additions thereto can be made without departing from the essences and scope of the present invention. Accordingly, it should be understood that the invention is not intended to be limited to the specific embodiments thereof set forth above, but to include all possible embodiments that can be made within the scope with respect to the features specifically set forth in the appended claims and to encompass all the equivalents thereof.

What is claimed is:

1. A rotary press comprising:

a printing unit having at least one printing cylinder for applying ink to paper to form printed paper;

a dryer disposed downstream of the printing unit for drying the ink on said printed paper;

a guide roller positioned between said printing unit and said dryer for guiding the printed paper from said printing unit into said dryer; and a drive unit drivingly coupled to said guide roller;

wherein said guide roller has a diameter which is equal to, or an integral multiple of, a diameter of the printing cylinder; and wherein said drive unit includes means for driving said guide roller to rotate synchronously with the printing cylinder and at a peripheral speed that is identical to that at which the printing cylinder is rotated so that the guide roller always comes in contact with an identical portion of an image printed onto the paper.

2. A rotary press as set forth in claim 1, wherein the rotary press is a multiweb rotary press comprising:

a plurality of paper feeders for supplying a plurality of webs, respectively;

a plurality of said printing units for applying ink to said webs to form printed webs, respectively; and a plurality of said guide rollers for guiding the printed webs from the printing units into the dryer, respectively;

wherein said dryer is disposed downstream of all said printing units for drying the printed webs;

wherein said paper feeders are disposed in line extending substantially in a direction in which the webs are supplied individually therefrom, and wherein the printing units are disposed in line extending substantially in a direction in which the webs from the paper feeders are to travel therethrough individually, whereby the webs are printed in parallel with one another, and the printed webs are then dried and thereafter placed one on top of another to form a product therefrom; and wherein one web which is printed through a printing unit that is disposed farthest downstream passes directly into the drier, and each of said plurality of webs other than said one web is guided by a guide roller disposed downstream of each of the respective printing units so as to bypass such printing units and said printing unit disposed farthest downstream and then to travel into the dryer.

3. A rotary press as set forth in claim 1, wherein the printing cylinder is replaceably inserted in said printing unit to be replaceable by a replacement printing cylinder, and the guide roller is replaceably installed in the rotary press to be replaceable by a replacement guide roller, whereby the replacement guide roller has a diameter which is equal to, or an integral multiple of, a diameter of the replacement printing cylinder.

4. A rotary press as set forth in claim 1, wherein said printing unit is a perfecting printer.

5. A rotary press as set forth in claim 2, wherein the printing cylinder is replaceably inserted in said printing unit to be replaceable by a replacement printing cylinder, and the guide roller is replaceably installed in the rotary press-to be replaceable by a replacement guide roller, whereby the replacement guide roller has a diameter which is equal to, or an integral multiple of, a diameter of the replacement printing cylinder.

6. A rotary press as set forth in claim 2, wherein said printing unit is a perfecting printer.

7. A rotary press as set forth in claim 3, wherein said printing unit is a perfecting printer.

* * * * *